US008409073B2

(12) United States Patent
Ibara et al.

(10) Patent No.: US 8,409,073 B2
(45) Date of Patent: Apr. 2, 2013

(54) INCUBATOR

(75) Inventors: Satoshi Ibara, Kagoshima (JP); Terumi Matsubara, Nerima-ku (JP); Eiji Koike, Saitama (JP); Shinichi Kobayashi, Kawaguchi (JP); Naoki Honma, Saitama (JP); Hidetoshi Sato, Saitama (JP); Kazuo Matsubara, Bunkyo-ku (JP)

(73) Assignee: Atom Medical Corporation, Tokyo (JP)

( * ) Notice: Subject to any disclaimer, the term of this patent is extended or adjusted under 35 U.S.C. 154(b) by 777 days.

(21) Appl. No.: 12/553,669

(22) Filed: Sep. 3, 2009

(65) Prior Publication Data

US 2010/0076248 A1 Mar. 25, 2010

(30) Foreign Application Priority Data

Sep. 24, 2008 (JP) ..... 2008-244596

(51) Int. Cl.
*A61G 11/00* (2006.01)

(52) U.S. Cl. ..... 600/22

(58) Field of Classification Search ..... 600/21, 600/22; 5/414, 416, 600, 603; 73/653, 655, 73/862.624, 862.324, 862.381; 359/88, 227; 356/32; 250/231.1, 231.19, 20, 206, 221, 250/222.1, 559.12; 324/244.1, 750.23, 754.23; 160/188, 193; 318/480, 266, 461, 468, 469; 340/556, 5.71, 5.7, 5.8; 128/202.12; 312/1, 312/3; 119/311, 328; 49/169, 170, 360, 49/362, 363, 26, 28; 187/316
See application file for complete search history.

(56) References Cited

U.S. PATENT DOCUMENTS

| | | | | |
|---|---|---|---|---|
| 4,627,297 | A * | 12/1986 | Akimoto | 73/862.324 |
| 5,453,077 | A * | 9/1995 | Donnelly et al. | 600/22 |
| 5,969,637 | A * | 10/1999 | Doppelt et al. | 340/12.55 |
| 6,181,095 | B1 * | 1/2001 | Telmet | 318/480 |
| 6,231,499 | B1 | 5/2001 | Jones | |
| 6,953,427 | B1 * | 10/2005 | Mackin et al. | 600/22 |

FOREIGN PATENT DOCUMENTS

| | | |
|---|---|---|
| WO | WO 99/12512 | 3/1999 |
| WO | WO 02/063406 | 8/2002 |

* cited by examiner

*Primary Examiner* — Charles A Marmor, II
*Assistant Examiner* — Eileen Foley
(74) *Attorney, Agent, or Firm* — Hunton & Williams LLP

(57) ABSTRACT

An incubator according to the present invention will be able to prevent accidents to the incubator itself or other devices, a doctor, a nurse or others causing external force even if the external force is applied to a canopy of a newborn chamber. An optical detector in a control mechanism detects application of external force to the canopy of the newborn chamber, and a signal output section in the control mechanism outputs a signal that renders a driving mechanism for lowering and raising the canopy non-operational when the application of external force is detected. Accordingly, even if external force is applied to the canopy by bump, contact, putting some object or others, the driving mechanism will not continue or start to lower or raise the canopy while the external force is applied to the canopy because the driving mechanism will be rendered non-operational.

3 Claims, 4 Drawing Sheets

INCUBATOR

TECHNICAL FIELD

The present invention relates to an incubator that has a driving mechanism for lowering and raising a canopy of a newborn chamber.

BACKGROUND ART

An incubator has a newborn chamber to provide appropriate physiological environment for a newborn who cannot adjust its body temperature and others by itself. In a closed type incubator, substantially entire areas of the sides and top of a newborn chamber are formed from transparent members so that a newborn in the newborn chamber can be seen from outside. Within the newborn chamber, not only temperature but also humidity, oxygen concentration and others are controlled. In an open type incubator, substantially entire areas of the sides of a newborn chamber are formed from transparent members, and a radiant heating source disposed above the newborn chamber controls the temperature of a bed for the newborn in the newborn chamber together with the temperature of the newborn itself.

Also known is a switching type incubator which can be switched between the closed type and open type as required by lowering or raising the canopy of the newborn chamber. In this switching type incubator, the canopy of the newborn chamber is lowered or raised by a driving mechanism such as an electric motor automatically or by hand if the driving mechanism malfunctions because the canopy of the newborn chamber has to be lowered or raised as described above (see, for example, Patent Literature 1).

CITATION LIST

Patent Literature

U.S. Pat. No. 6,231,499

SUMMARY OF INVENTION

Technical Problem

In the switching type incubator, when the canopy of the newborn chamber is automatically lowered or raised by the driving mechanism, the canopy might be lowered or raised while the canopy bumps against or comes into contact with other devices near the incubator or a person's body such as that of a doctor, a nurse or others, or while some object is put on the canopy, in other words, while external force is applied to the canopy. If the driving mechanism for the canopy continues or starts to lower or raise the canopy in such circumstances, accidents may happen to the incubator itself or the other devices, the doctor, the nurse or others causing the external force. Accordingly, it is an object of the invention to provide an incubator that will be able to prevent accidents to the incubator itself or other devices, a doctor, a nurse or others causing the external force, even if the external force is applied to a canopy of a newborn camber.

Solution to Problem

In an incubator according to the present invention, a detecting section in a control mechanism detects application of external force to a canopy of a newborn chamber, and a signal output section in the control mechanism outputs a signal that renders a driving mechanism non-operational when the application of external force is detected. Accordingly, even if external force is applied to the canopy of the newborn chamber by bump, contact, putting some object or others, the driving mechanism for the canopy will not continue or start to lower or raise the canopy while the external force is applied to the canopy because the driving mechanism for the canopy will be rendered non-operational. The application of external force may be detected, for example, by detecting displacement or strain of at least part of the canopy, by detecting variation in pressure applied to at least part of the canopy, or by detecting variation in driving current or driving frequency in the driving mechanism for the canopy.

Advantageous Effects of Invention

In the incubator according to the present invention, even if external force is applied to the canopy of the newborn chamber by bump, contact, putting some object or others, the driving mechanism for the canopy will not continue or start to lower or raise the canopy while the external force is applied to the canopy because the driving mechanism for the canopy will be rendered non-operational. Accordingly, it will be able to prevent accidents to the incubator itself or other devices, a doctor, a nurse or others causing the external force.

DESCRIPTION OF EMBODIMENTS

Figure 2:
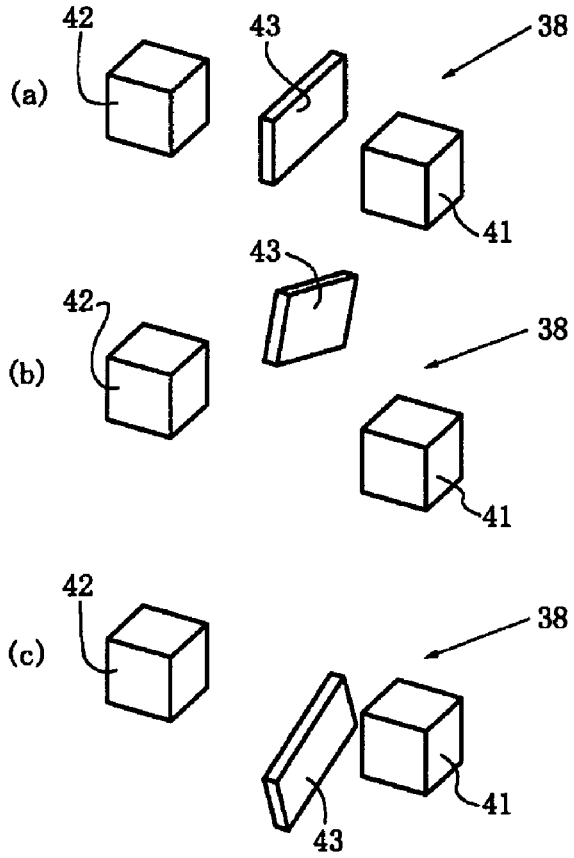
FIG. 2 Perspective views of an optical detector in the incubator according to one embodiment of the present invention, in which (a) shows a state in which light is not detected, and (b) and (c) show a state in which light is detected.
Figure 3:
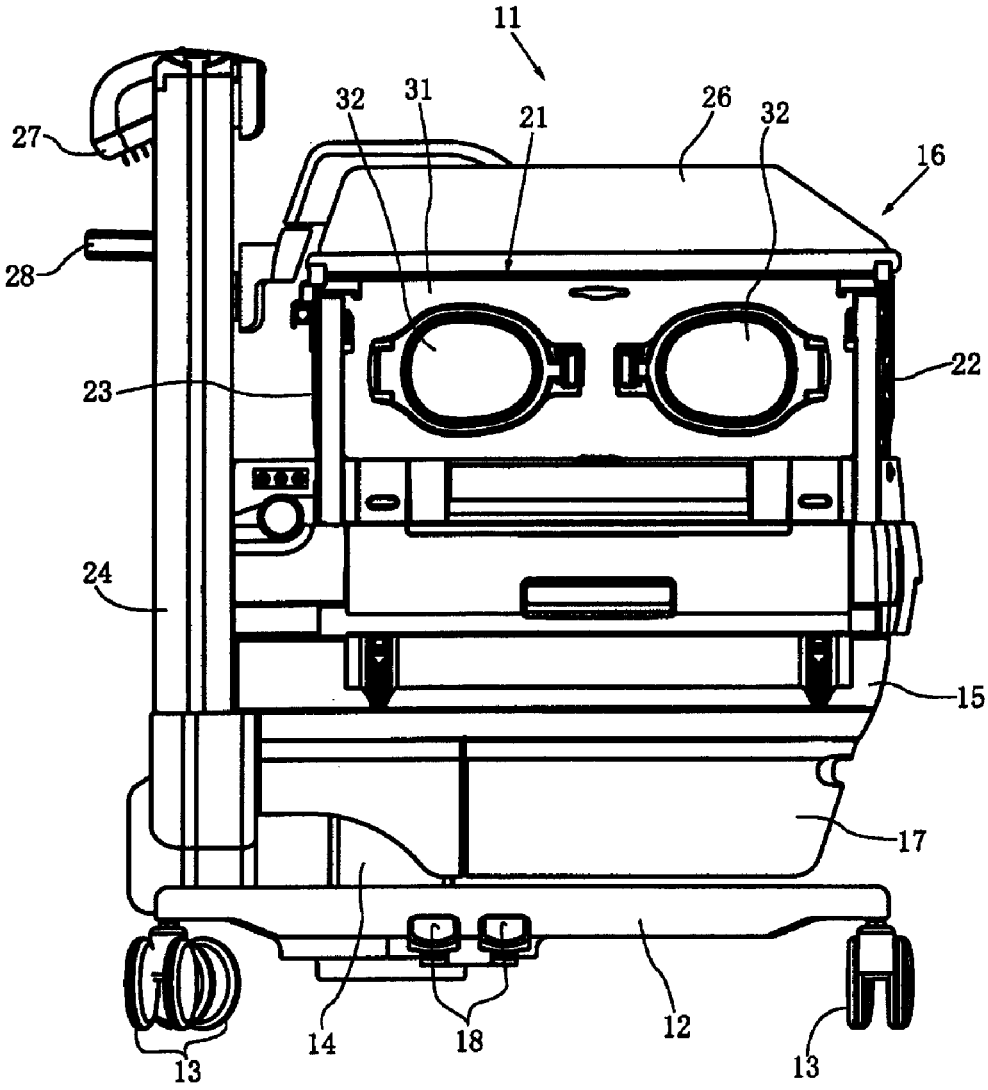
FIG. 3 A side view of the incubator, in a state of a closed type, according to one embodiment of the present invention.
Figure 4:
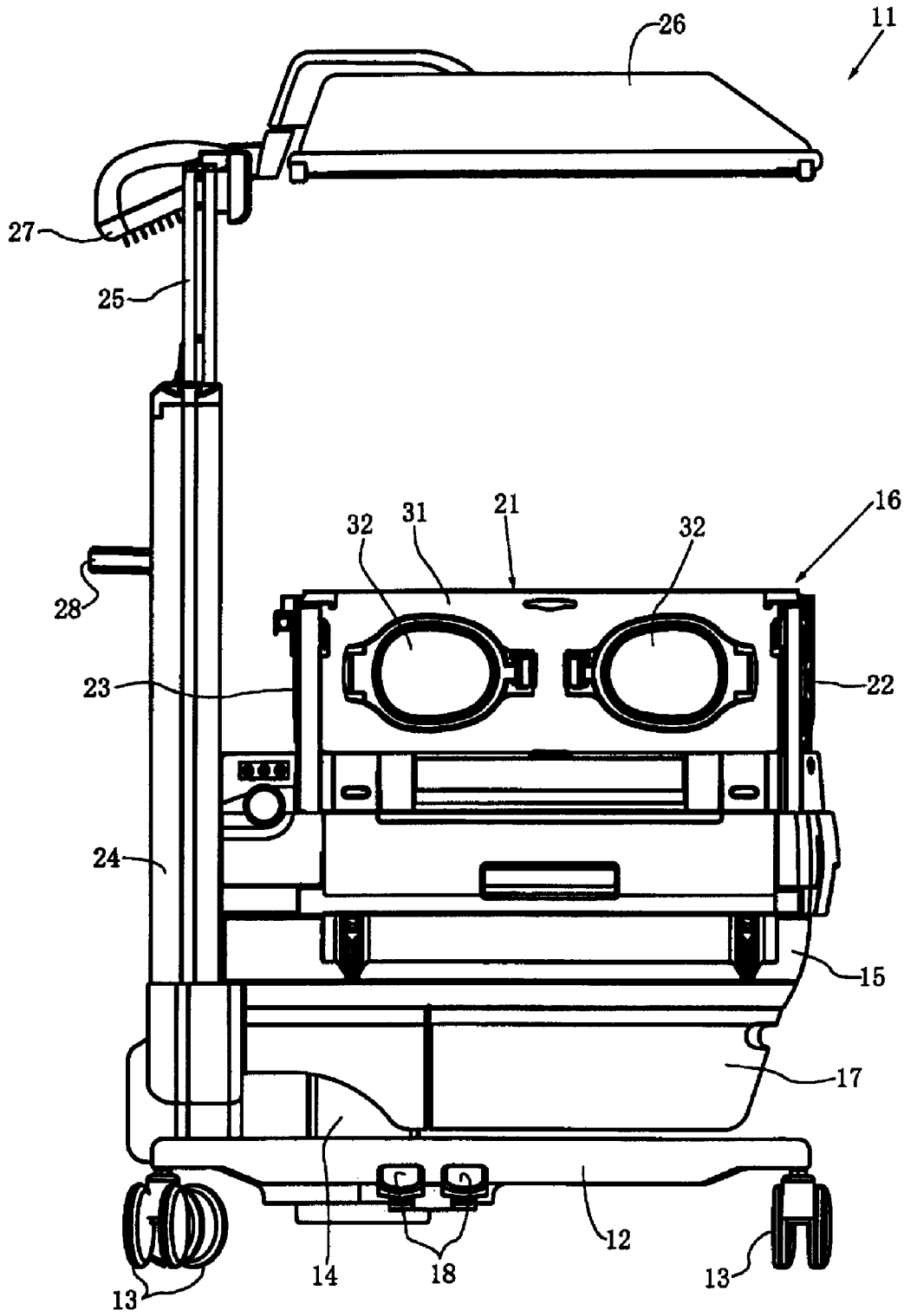
FIG. 4 A side view of the incubator, in a state of an open type, according to one embodiment of the present invention.

An embodiment according to the present invention will hereinafter be described with reference to FIGS. 1 to 4. FIGS. 3 and 4 show an incubator according to the present embodiment which is in a closed type and an open type respectively. In the incubator 11, wheels 13 and a support 14 are attached to a frame 12. A base 15 is supported on the support 14. Within the base 15 is a control mechanism (not shown) for temperature, humidity and others. Disposed on the base 15 is a newborn chamber 16. A drawer 17 for use as storage is attached under the base 15. Pedals 18 are also attached to the frame 12 in order to adjust the height of the base 15 or others along the support 14.

A bed (not shown) is disposed in the newborn chamber 16. Formed in the sides of the newborn chamber 16 are: a pair of left and right treatment doors 21 which are located on the left and right sides of a newborn (not shown) lying on the bed; a foot end treatment door 22 which is located at the foot end; and a head end treatment wall 23 which is located at the head end. A pair of left and right posts 24 is also attached to the frame 12. Another pair of left and right posts 25 (see FIG. 4) is nested in the pair of left and right posts 24. The respective posts 25 are slidable within the respective posts 24.

A canopy 26 of the newborn chamber 16 and an infrared heater 27 are supported one each by the left and right posts 25. By sliding the posts 25 within the corresponding posts 24, the canopy 26 and infrared heater 27 can be raised or lowered independently. They are raised or lowered by an operating instruction given from a doctor, a nurse or others to a driving mechanism such as an electric motor (not shown). The canopy 26 is also made of a transparent material. Attached also to the posts 24 is a protector 28 that prevents the infrared heater 27 from bumping against a wall (not shown) of a room. The left and right treatment doors 21 each have a transparent wall 31. The walls 31 have a pair of left and right hand insertion windows (not shown), and a pair of left and right hand insertion doors 32 which opens or closes the windows.

Figure 1:
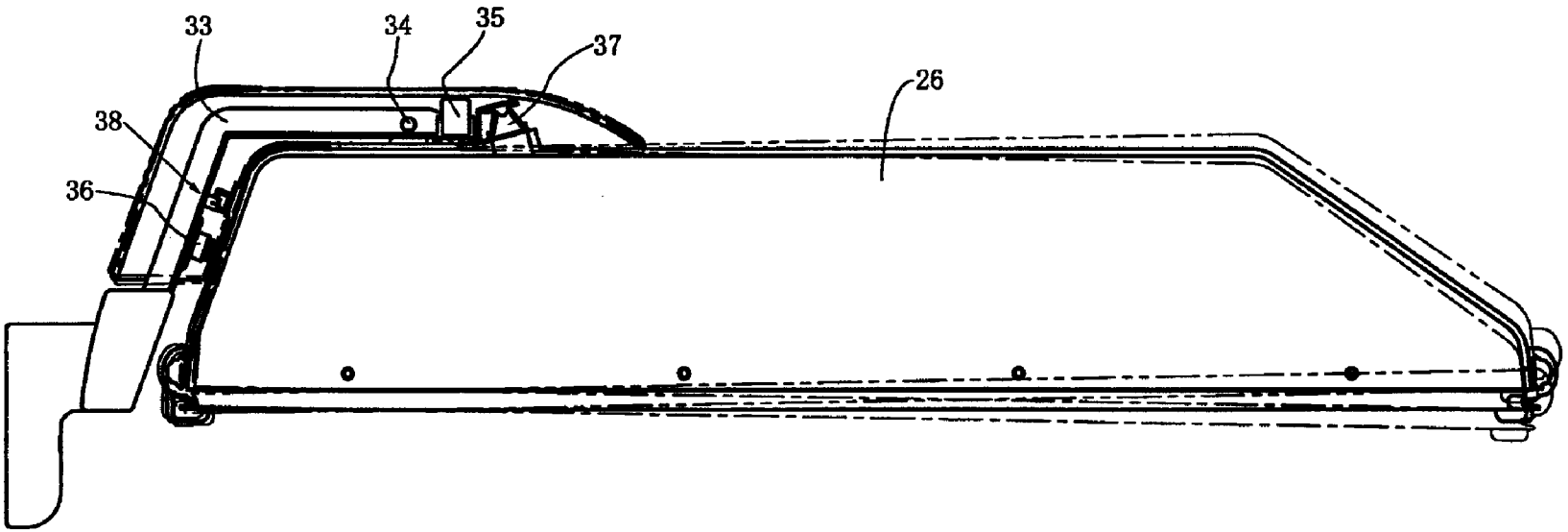
FIG. 1 A vertical section of a canopy and its vicinity of an incubator according to one embodiment of the present invention.

FIG. 1 shows the canopy 26 and its vicinity. A support arm 33 is attached to one of the pair of left and right posts 25, and the canopy 26 is suspended from the support shaft 34 of the support arm 33. Attached to the support arm 33 is a pair of elastic supports 35 and 36. The elastic supports 35 and 36 press the canopy 26, thereby limiting rotational range of the canopy 26 around the support shaft 34 to a predetermined angle. The elastic supports 35 and 36 may each be structured, for example, by attaching a semispherical press member made of rubber to the leading end of a helical compression spring. Disposed near the elastic support 35 of the canopy 26 is a light source 37 for illumination, etc.

This incubator 11 is provided with a control mechanism for controlling the raising and lowering of the canopy 26. The control mechanism has an optical detector 38 that detects application of external force to the canopy 26; and a signal output section (not shown) that outputs a signal that renders the driving mechanism for the canopy 26 non-operational when the application is detected. As shown in FIG. 2, the optical detector 38 has: a light emitting element 41 and a light receiving element 42 mounted on the support arm 33 so as to be opposite to each other; and a light shield 43 mounted on the canopy 26 and extending toward a space between the light emitting element 41 and light receiving element 42.

When the canopy 26 is suspended from the support shaft 34 in a normal state and external force is not applied to the canopy 26, the light shield 43 is situated between the light emitting element 41 and light receiving element 42 as shown in FIG. 2 (*a*), and light emitted from the light emitting element 41 is intercepted by the light shield 43 and does not enter the light receiving element 42. In this case, the signal output section in the control mechanism does not output a signal. If a doctor, a nurse or others gives an operating instruction to the driving mechanism for the canopy 26 in this condition, the canopy 26 is raised or lowered according to this operating instruction.

However, for example, if some object is put on an area, opposite to the posts 25 with respect to the support shaft 34, of the canopy 26, this canopy 26 rotates around the support shaft 34 clockwise in FIG. 1 through a certain angle against the elastic support force of the elastic support 36, as indicated by a chain line in FIG. 1. If the light shield 43 moves out of the space between the light emitting element 41 and light receiving element 42 as shown in FIG. 2 (*b*) due to the rotation, light emitted from the light emitting element 41 is not intercepted by the light shield 43 and enters the light receiving element 42.

In this case, the signal output section in the control mechanism outputs a signal. Even if a doctor, a nurse or others gives an operating instruction to the driving mechanism for the canopy 26 in this condition, the canopy 26 will not be raised or lowered regardless of this operating instruction. Additionally, for example, if some object falls on an area, opposite to the posts 25 with respect to the support shaft 34, of the canopy 26 in the course of raising or lowering the canopy 26, or if the head of a doctor, a nurse or others bumps against an area, on the posts 25 side with respect to the support shaft 34, of the canopy 26 in the course of lowering the canopy 26, the light shield 43 in the optical detector 38 may come to a state as shown in FIG. 2 (*b*). In this case also, the signal output section in the control mechanism outputs a signal. Consequently, the raising or lowering of the canopy 26 is halted by the output of this signal.

Alternatively, for example, if some object is put on an area, on the posts 25 side with respect to the support shaft 34, of the canopy 26, this canopy 26 rotates around the support shaft 34 counterclockwise in FIG. 1 through a certain angle against the elastic support force of the elastic support 35, as indicated by a chain double-dashed line in FIG. 1. If the light shield 43 moves out of the space between the light emitting element 41 and light receiving element 42 as shown in FIG. 2 (*c*) due to the rotation, light emitted from the light emitting element 41 is not intercepted by the light shield 43 and enters the light receiving element 42. In this case also, the signal output section in the control mechanism outputs a signal. Even if a doctor, a nurse or others gives an operating instruction to the driving mechanism for the canopy 26 in this condition, the canopy 26 will not be raised or lowered regardless of this operating instruction.

Further, for example, if some object falls on an area, on the posts 25 side with respect to the support shaft 34, of the canopy 26 in the course of raising or lowering the canopy 26, or if the head of a doctor, a nurse or others bumps against an area, opposite to the posts 25 with respect to the support shaft 34, of the canopy 26 in the course of lowering the canopy 26, the light shield 43 in the optical detector 38 may come to a state as shown in FIG. 2 (*c*). In this case also, the signal output section in the control mechanism outputs a signal. Consequently, raising or lowering of the canopy 26 is halted by the output of this signal.

In the incubator 11 in the forgoing embodiment, the light emitting element 41 and light receiving element 42 are mounted on the support arm 33, and the light shield 43 is mounted on the canopy 26. However, these positions may be reversed; that is, the light emitting element 41 and light receiving element 42 may be mounted on the canopy 26, and the light shield 43 may be mounted on the support arm 33.

Further, in order to detect application of external force to the canopy 26, the incubator 11 in the foregoing embodiment uses an optical detector 38 serving as a non-contact sensor. However, instead of the optical detector 38, various devices may be used to detect application of external force. For example, as non-contact type sensors, ultrasonic detectors, in which an ultrasonic transmitter, ultrasonic receiver, and ultrasonic interceptor correspond to the light emitting element 41, light receiving element 42, and light shield 43, respectively, may be used. Additionally, a strain gauge may be stuck to a portion, most apt to be strained by the application of external force, of the canopy 26, for example, a portion near the support shaft 34.

Further, in order to detect external force itself applied to the canopy 26, a pressure sensor may be stuck to, for example, an upper surface or peripheral edge of the canopy 26. Additionally, if external force is applied to the canopy 26 during driving this canopy 26 by an electric motor, the driving current and driving frequency of the electric motor varies. That is, if the load on the electric motor for driving the canopy 26 varies due to application of external force to the canopy 26, the driving current of the electric motor varies, and slippage variation due to the load variation would also lead to variation in the rotating speed of the electric motor. Accordingly, a detector that detects abnormal values of the driving current or rotating speed of the electric motor for driving the canopy 26 may also be used.

INDUSTRIAL APPLICABILITY

The present invention can be applied, for example, to manufacturing a switching type incubator with a driving mechanism for lowering and raising a canopy of a newborn chamber, thereby allowing switching of the incubator between the closed type and open type as required.

REFERENCE SIGNS LIST

11 Incubator
16 Newborn chamber
26 Canopy
33 Support arm
38 Optical detector (detecting section, non-contact type sensor)
41 Light emitting element
42 Light receiving element
43 Light shield

The invention claimed is:

1. An incubator provided with a driving mechanism for lowering and raising a canopy of a newborn chamber, the incubator comprising:

a control mechanism including:

a detecting section which detects application of external force to the canopy; and a signal output section which outputs a signal that renders the driving mechanism non-operational when the application is detected, wherein the detecting section is a non-contact type sensor that detects displacement of at least part of the canopy, and the non-contact type sensor is an optical detector that has: a light emitting element and a light receiving element disposed opposite to each other; and a light shield extending toward a space between the light emitting element and the light receiving element, wherein light emitted from the light emitting element is intercepted by the light shield and does not enter the light receiving element while the external force is not applied, and the signal output section does not output the signal and the driving mechanism can be operated in the intercepted condition.

2. The incubator according to claim 1, wherein if light emitted from the light emitting element is not intercepted by the light shield and enters the light receiving element while the driving mechanism is non-operational, the signal output section outputs the signal and the driving mechanism cannot be started to operate.

3. The incubator according to claim 1, wherein if light emitted for the light emitting element is not intercepted by the light shield and enters the light receiving element while the driving mechanism is operation, the signal output section outputs the signal and the driving mechanism is stopped for operating.

* * * * *